United States Patent [19]

Sheu

[11] Patent Number: 4,941,328

[45] Date of Patent: Jul. 17, 1990

[54] METAL CAN ENDS WITH METAL PULL TABS BONDED THERETO

[76] Inventor: Lai-Fa Sheu, No. 8, Alley 8, Lane 26, Sec. 3, Tay-Ho Rd., Changhua City, Taiwan

[21] Appl. No.: 376,677

[22] Filed: Jul. 7, 1989

[51] Int. Cl.[5] ..... F25D 3/10

[52] U.S. Cl. ..... 62/294; 62/4; 62/457.9

[58] Field of Search ..... 62/457.9, 294, 4

[56] References Cited

U.S. PATENT DOCUMENTS

| | | | |
|---|---|---|---|
| 3,309,890 | 3/1967 | Barnett et al. | 62/4 X |
| 3,494,142 | 2/1970 | Beck | 62/294 |
| 4,679,407 | 7/1987 | Kim et al. | 62/294 |
| 4,688,395 | 8/1987 | Holcomb | 62/294 |

*Primary Examiner*—Lloyd L. King

*Attorney, Agent, or Firm*—Birch, Stewart, Kolasch & Birch

[57] ABSTRACT

A metal can includes a metal tube having an open end sealed to a closed end of the can. The closed can end has a first score line defining a first area of the can end to be detached from the can so as to provide a common access, including a first access to an interior of the can and a second access to an interior of the tube. The closed can end further has a C-shaped score line formed within the first area thereof defining a second area which has a nondetachable portion bendably connected with the first area. The second area may be detached from the can so as to form an aperture right above the open end of the metal tube. A pull tab is attached to an upper side of the second area. A second score line is formed on the metal tube defining an arcuate area adjacent the open end of the metal tube which has a nondetachable portion perpendicularly connected to a lower side of the first area.

3 Claims, 5 Drawing Sheets

METAL CAN ENDS WITH METAL PULL TABS BONDED THERETO

BACKGROUND OF THE INVENTION

This invention relates to a metal can having a metal tube connected to a closed end thereof, and more particularly to a metal can end which has a score line defining an openable area to give an access to the interior of the can and the metal tube, as well as a C-shaped score line defining a partially openable area to form an aperture above an open end of the metal tube.

Referring to FIG. 1, a perspective view of a conventional metal can 6 is shown. Such a metal can has a metal tube 2 to be filled with compressed cooling medium 7, such as $CCl_2F_2$, having an open end 3 sealed connected to a closed end 5 of the can 6 and a pull ring 4 riveted to a score-defined area 1 of the can end right above the open end 3 of the metal tube 2. The compressed cooling medium 7 is released from the metal tube 2 by initially pulling up the pull ring 4 to access the open end 3 of the metal tube 2. The compressed cooling medium 7 is then vaporized, reducing the temperature of the can. As a result, the liquid contents of the can 6 will in turn be cooled. The pull ring 4 is then further pulled up so as to allow access to the interior of the metal can 6 for drinking the contents thereof. However, during pulling process, the pull ring 4 is commonly pulled too far, accessing the open end 3 of the metal tube 2 and the interior of the metal can 6 at the same time. If this happens, the contents of the metal can 6 may overflow into said metal tube 2 and mix with the compressed cooling medium 7 resulting in a local overcooling effect in said metal tube which reduces the overall cooling efficiency. To overcome the abovementioned disadvantage of the prior art metal can, another conventional metal can of the type which is provided with a metal tube for cooling the contents contained therein has been developed, as shown in FIG. 2. The illustrated metal can 6' has an upper closed end 5' provided with a pull ring 4' riveted to a score-defined area to be detached to give access to the interior of said metal can 6', and a lower can end 8 to which the open end of the metal tube 2 is attached. The lower can end 8 has an opening tab (not shown) which is detached from an aperture to allow the compressed cooling medium 7' contained in the metal tube 2' to vaporize therethrough. Therefore, the content of the metal can 6' will not mix with the cooling medium, adversely affecting the overall cooling effect. However, such an arrangement metal can 6' will increase the manufacturing cost and the complexity of the production process of the metal can.

SUMMARY OF THE INVENTION

It is therefore a main object of this invention to provide a metal can of the abovementioned type having a metal tube for cooling the content thereof, wherein said contents of said can will not flow into said metal tube to mix with the compressed cooling medium contained in said metal tube when a closed end of said metal tube is opened, said metal can being simply and cost-effectively produced.

Accordingly, a metal can of this invention includes a metal tube having an open end sealed to a closed end of the can. Said closed can end has a first score line defining a first area thereof which is to be detached by tearing along the first score line to provide a common access which includes a first access to an interior of the can and a second access to an interior of the tube. Said closed can end further has a C-shaped score line formed within the first area thereof defining a second area which has a nondetachable portion bendably connected with the first area. The second area may be detached by tearing along the C-shaped score line so as to form an aperture above the open end of the metal tube. A pull tab is attached to an upper side of the second area away from the nondetachable portion so that the second area of the closed can end can be detached in a first direction from said first access to said second access. A second score line is formed on the metal tube defining an arcuate area adjacent the open end of the metal tube which has a nondetachable portion perpendicularly connected to a lower side of the first area so as to facilitate the detachment of the first area of the closed can end in a second direction opposed to the first direction after the second area of the closed end is pulled up.

Initially, the second area of the can end is pulled up in said first direction to form an aperture allowing the compressed cooling medium contained in the metal tube to vaporize therefrom. Then, the first area is detached from the can end by pulling the pull tab backward to provide access to the interior of said metal can. Therefore, the contents of said metal can will not flow into the metal tube. In addition, the score-defined first and second areas are formed on the same can end, thus simplifying the production process.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENTS

Figure 1:
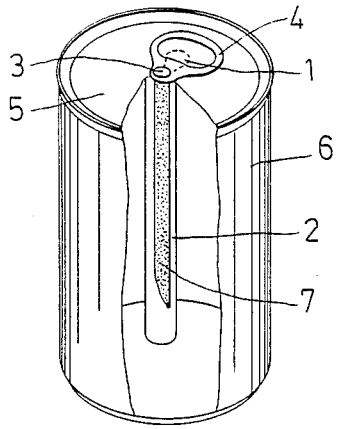
PRIOR ART FIG. 1
FIG. 1 is a perspective view of a conventional metal can having a metal tube installed therein for cooling the contents thereof.
Figure 2:
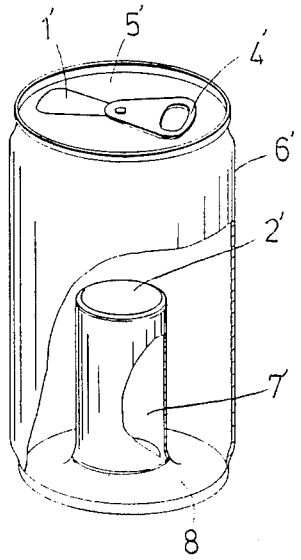
PRIOR ART FIG. 2
FIG. 2 is a perspective view of another conventional metal can having a metal tube installed therein for cooling the contents thereof.
Figure 3:
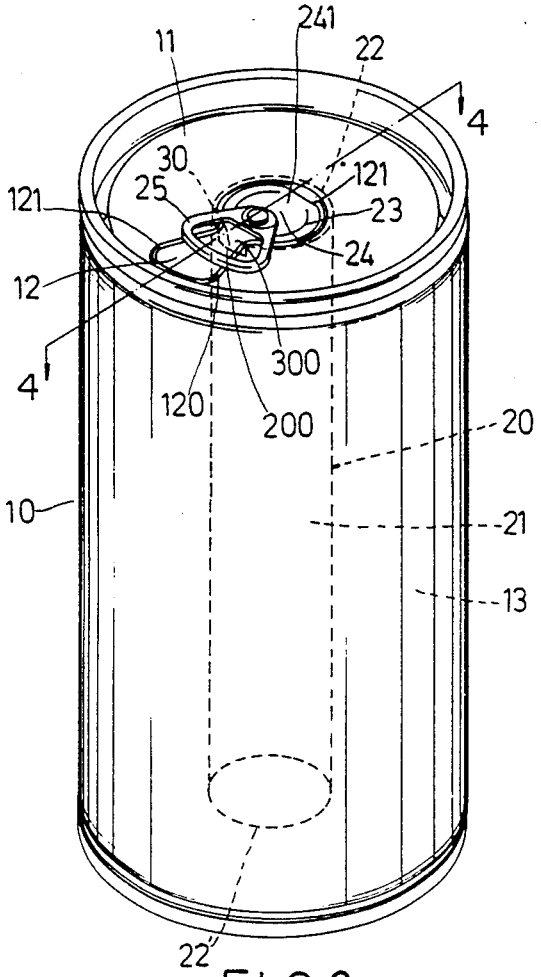
FIG. 3 is a perspective view of a preferred embodiment of a metal can of this invention.
Figure 4:
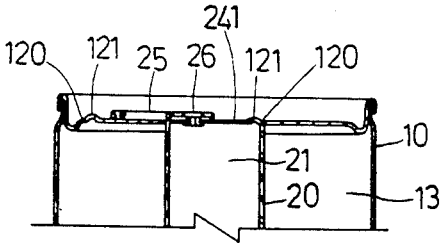
FIG. 4 is a fragmentary sectional view of FIG. 3 taken along a line 4—4.
Figure 5:
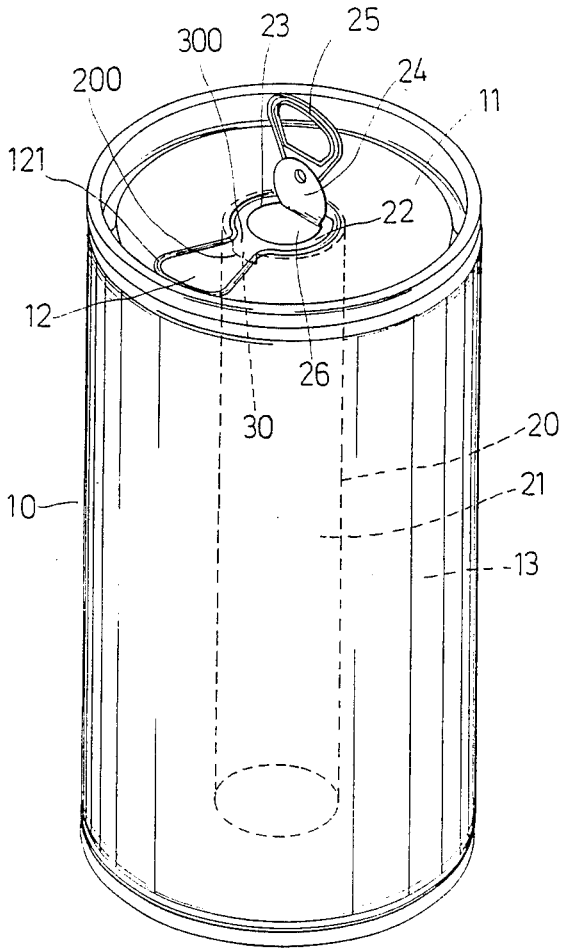
FIG. 5 is a schematic view showing a preferred embodiment of a metal can of this invention in which an aperture is formed above the metal tube.
Figure 6:
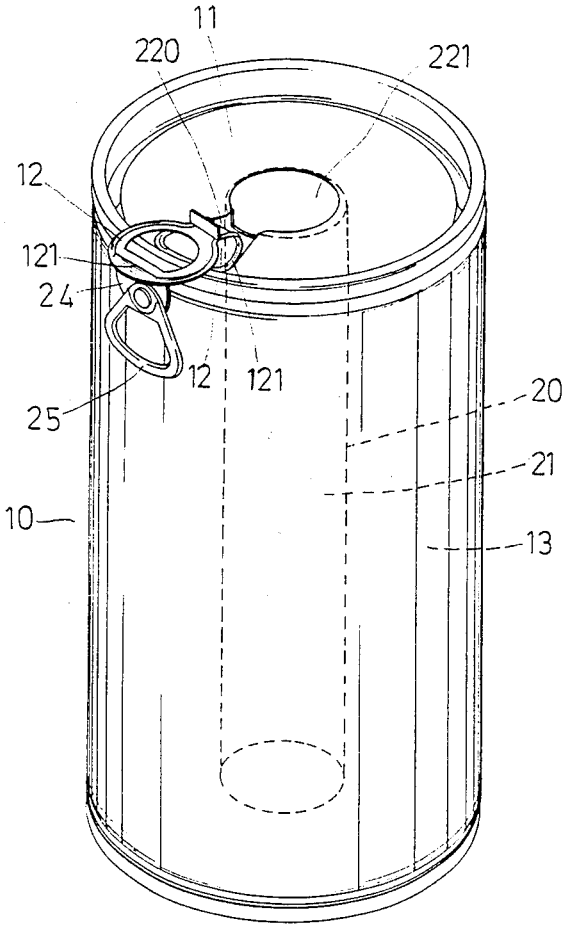
FIG. 6 is a schematic view showing a metal can of FIG. 5 in which the pull ring is detached to provide access to the interior of the metal can.

Referring to FIGS. 3, 4, a preferred embodiment of a metal can with two closed ends is shown. The metal can 10 includes a metal tube 20 which is filled with a compressed cooling medium 21, such as $CCl_2F_2$. The metal tube 20 has a closed end 22' and an open end 22 which are sealed to one of the closed ends of the can 11. Said end 11 of the can 10 is provided with a first score line 120 defining a first area 12 thereof which is to be detached by tearing along said first score line to provide a common access, including a first access 220 to the interior of the metal can 10 and a second access 221 to the interior of the metal tube 20. A C-shaped score line 23 is formed within the first area 12 of the can end 11 which defines a second area 24 having a nondetachable portion 241 bendably connected to said first area 12 of the can 10. A pull tab 25 is riveted to the upper side of the second area 24 of the can end 11 away from the nondetachable portion 241. The second area may be detached by tearing along said C-shaped score line in a first direction from said first access 220 to said second access 221 so as to form an aperture 26 above the open end 22 of the metal tube 20, as best illustrated in FIG. 5. The first area 12 is then detached by pulling the pull tab 25 in a second direction opposed to the first direction to provide a first access 220 to the interior of the metal can 10 and a second access 221 which exposes the greater part of the open end 22 of the metal tube 20, as illustrated in FIG. 6. To prevent any interconnection between the first area 12 and the wall of the metal tube 20 when said first area is torn away from the can end 11, a second score line 200 is formed on the wall of metal tube 20 defining an arcuate area 30 adjacent said open end 22 of the metal tube 20. The arcuate area 30 has a nondetachable portion 300 perpendicularly connected to the lower side of the middle portion of the first area 12 of the can end 11 which is to be torn away together with said first area 12 of the can end 11. The first area 12 has a reinforcing hollow rib 121 projecting along the first score line 120 to increase structural rigidity.

The second area 24 of the can end 11 is, in use, first pulled up to form an aperture 26 allowing the compressed cooling medium 21 contained in the metal tube 20 to vaporize therefrom, the first access 220 to the interior of the can 10 not being accidentally opened by this pulling action. At this stage, the liquid contents 13 of the can 10 are cooled by metal tube 20 due to the evaporation of the compressed cooling medium 21 contained therein. The first area 12 is completely torn away from the can end 11 by pulling the pull tab 25 backward to provide access to the the contents 13 of said metal can 10. In this way, the content 13 of said metal can 10 will not flow into the metal tube 20 to mix with the compressed cooling medium 21 contained therein. It is noted that the score-defined first and second areas 12, 24 are designed to be integrally formed on the same can end 11, thus lowering the manufacturing cost and simplifying the production process.

Figure 7:
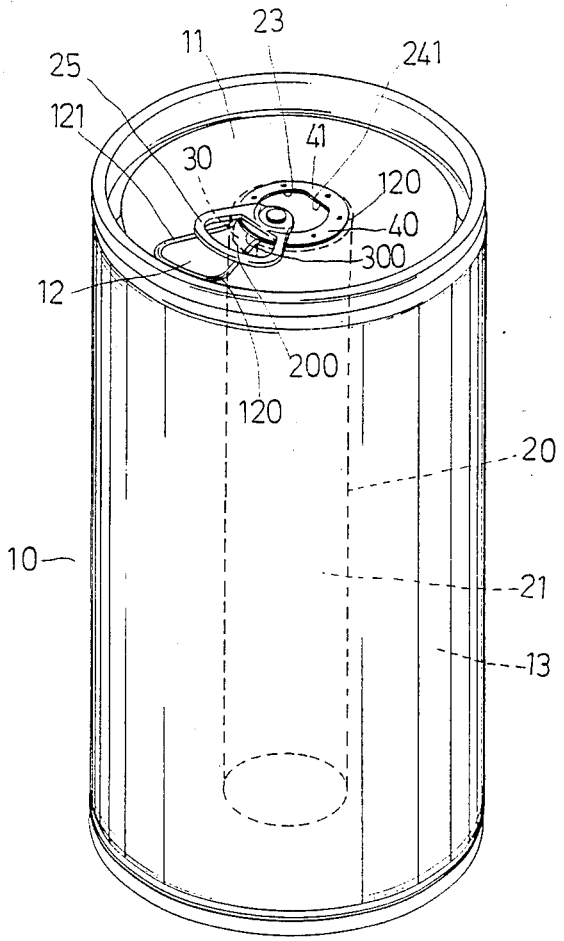
FIG. 7 is a perspective view of another preferred embodiment of this invention.

In a variation, illustrated in FIG. 7, a part of the reinforcing rib 121 of the first preferred embodiment is replaced by a reinforcing ring 40 which is attached to the can end 11 between the first score line 120 and said C-shaped score line 23 right above said open end of said metal tube. The reinforcing ring 40 has a broadened segment 41 extending over the nondetachable portion 241 of the second area 24 so as to prevent the nondetachable portion 241 of the second area 24 from breaking when the pull tab 25 is pulled up.

With this invention thus explained, it is apparent that numerous modifications and variations can be made without departing from the spirit and scope of this invention. It is therefore intended that this invention be limited only as indicated in the appended claims.

I claim:

1. A metal can with two closed ends having a metal tube installed therein which contains a compressed cooling medium, said metal tube having a closed end and an open end sealed to one of said closed ends of the can, said one of said closed ends of said can being provided with a first score line defining a first area thereof which is to be detached from said can by tearing along said first score line to provide a common access, including a first access to an interior of said metal can and a second access to an interior of said metal tube, and a metal pull tab attached to an upper side of said first area, characterized in that said one of said closed ends of said can has a C-shaped score line formed within said first area thereof defining a second area which has a nondetachable portion bendably connected to said first area, said second area being adapted to be detached from said can by tearing along said C-shaped score line in a first direction from said first access to said second access so as to form an aperture above said open end of said metal tube, said pull tab being attached to an upper side of said second area away from said nondetachable portion, and a second score line formed on said metal tube defining an arcuate area adjacent said open end of said metal tube having a nondetachable portion perpendicularly connected to a lower side of said first area, said arcuate area of said metal tube being adapted to be torn away from said metal tube by tearing along said second score line with said nondetachable portion thereof attaching to said lower side of said first area so as to facilitate a detachment from said can of said first area in a second direction opposed to said first direction after said second area is pulled up.

2. A metal can as claimed in claim 1, wherein said first area has a reinforcing hollow rib projecting along said first score line.

3. A metal can as claimed in claim 1 further having a reinforcing ring attached to one of said closed ends thereof between said first score line and said C-shaped score line right above said open end of said metal tube, said reinforcing ring having a broadened segment which extends over said nondetachable portion of said second area, and a reinforcing hollow rib projecting along said first area right above said first access.

* * * * *